US006363564B1

(12) United States Patent
Weaver

(10) Patent No.: US 6,363,564 B1
(45) Date of Patent: Apr. 2, 2002

(54) THREE-PIECE BRIDGE JOINT

(75) Inventor: Brian F. Weaver, Burlington, KY (US)

(73) Assignee: Progress Rail Services Corp., Albertville, AL (US)

( * ) Notice: Subject to any disclaimer, the term of this patent is extended or adjusted under 35 U.S.C. 154(b) by 0 days.

(21) Appl. No.: 09/923,692

(22) Filed: Aug. 7, 2001

Related U.S. Application Data

(63) Continuation-in-part of application No. 09/635,152, filed on Aug. 8, 2000.

(51) Int. Cl.[7] ..... E01B 11/00; B61J 1/00; E01D 19/04

(52) U.S. Cl. ..... 14/56; 14/73.5; 238/171; 104/46; 104/47

(58) Field of Search ..... 14/56, 57, 64, 14/65, 73.1, 73.5, 77.1; 238/21, 22, 23, 47, 151, 171, 175, 179, 182, 190, 192, 194, 218, 228, 258; 104/46, 47, 35

(56) References Cited

U.S. PATENT DOCUMENTS 850,161 A * 4/1907 Hysan ..... 104/47
2,067,695 A * 1/1937 Conley ..... 238/171
2,875,325 A * 2/1959 Koenig ..... 246/118
3,008,644 A * 11/1961 Wagner ..... 238/171
4,171,774 A * 10/1979 Deslauriers ..... 238/171
4,785,994 A * 11/1988 Crone et al. ..... 238/171
5,590,833 A * 1/1997 Benenowski et al. ..... 238/171

* cited by examiner

*Primary Examiner*—Gary S. Hartmann
(74) *Attorney, Agent, or Firm*—Bracewell & Patterson, LLP

(57) ABSTRACT

A bridge joint for use with a railroad track having standard rail sections with flanges. The bridge joint includes a fixed point section having an integral accepting portion with a point and laterally spaced side walls, and a standard rail abutting portion. The joint also has a moveable point section having a yoke portion with a point and laterally spaced side walls, and a standard rail abutting portion. A rocker arm has a moveable interface portion adapted to be pivotally attached to said yoke portion and a fixed interface portion adapted to be received in said accepting portion. Clamping lugs arc positioned on the side walls of the accepting portion and the yoke portion. The fixed point section and the moveable point section are clamped to base plates with clamping members that engage the clamping lugs. Quick release fasteners are positioned to engage flanges along the fixed point section, moveable point section, and a flange of each of the standard rail sections and secure all to the base plates such that they are removable from the topside of the base plates.

16 Claims, 7 Drawing Sheets

THREE-PIECE BRIDGE JOINT

This application is a continuation-in-part of Application No. 09/635,152, filed Aug. 8, 2000.

BACKGROUND OF THE INVENTION

1. FIELD OF THE INVENTION

This invention relates to a railway bridge joint. More specifically, this invention relates to a three piece bridge joint having cast members which can be easily removed and replaced.

2. DESCRIPTION OF THE RELATED ART

Bridge joints are commonly used along a railroad track to allow a bridge structure to rotate horizontally. Such rotating bridges are an alternative to draw bridges. Bridge joints of the prior art have included a fixed point section, moveable point section, and a rocker arm that together maintain a substantially continuous surface on which the rail car rides. The rocker arm is pivotally attached to the moveable point section and rotates up away from the fixed point section to allow the bridge to rotate horizontally. The point sections are joined to the support substrate with planar base plates which are usually bolted to the support substrate and many times are integral to the sections. As the sections wear from rail car traffic they must periodically be removed and replaced. To remove such integral sections, the base plates must also be removed, which is a time consuming, costly process.

Other prior art bridge joints have sections that are bolted to the base plates. However, because these designs incorporate bolts that pass through the base plates, access to the underside of the base plates is required to remove the cast sections. If access is unavailable, the base plates must be removed with the rail sections before the sections can be removed from the base plates.

Thus, there is a need for a bridge joint having cast sections that can be easily and inexpensively replaced without requiring removal of the base plates.

BRIEF SUMMARY OF THE INVENTION

The present invention is directed to a bridge joint having cast sections that can be its removed from the base plates and replaced without access to the underside of the base plates or bridge structure. The bridge joint has first and second planar base plates. A fixed point section is mounted to the first base plate and has an integral accepting portion with a point and flanges extending opposite the accepting portion. A moveable point section mounted to the second base plate has a yoke portion which has a point, pivot pin, and opening, and flanges extending opposite the yoke section. A rocker is pivotally attached to the moveable point section by the pivot pin in the yoke portion. The rocker has a fixed interface portion adapted to be received in the accepting portion of the fixed point section and a moveable interface portion adapted to be pivotally received in the yoke portion of the moveable point section. The rocker has slots adapted to accept the points at both interfaces, and the moveable interface has knuckles for pivoting on the pivot pin and a clevis connected to a lever activated by the bridge pivot mechanism.

A plurality of quick release fasteners are secured to the base plates for engaging the flanges and securing the fixed point section to the first base plate and the moveable point section to the second base plate. The fasteners are operated from an upper side. The fasteners have spring clips for engaging the flanges. The quick release fasteners have a base, and the flanges have notches adapted to engage the base.

A plurality of clamping lugs are positioned on the fixed point section and the moveable point section. A plurality of clamps correspond to the clamping lugs. The clamps have clamping plates adapted to engage and restrain vertical and horizontal movement of the clamping lugs and are releasably secured to the base plates. The clamps are operated from an upper side. There are clamping lugs on the accepting portion of the fixed point section and on the yoke portion of the moveable point section.

Both the moveable point section and the fixed point section have standard rail mating portions adapted to laterally abut and join with standard rail sections. The standard rail sections have a flange opposed to the mating portion which is secured to the base plate with the quick release fasteners. The accepting portion and the yoke portion have spaced side walls positioned closely adjacent to the interface portions of the rocker.

DETAILED DESCRIPTION OF THE PREFERRED EMBODIMENT

Figure 1A:
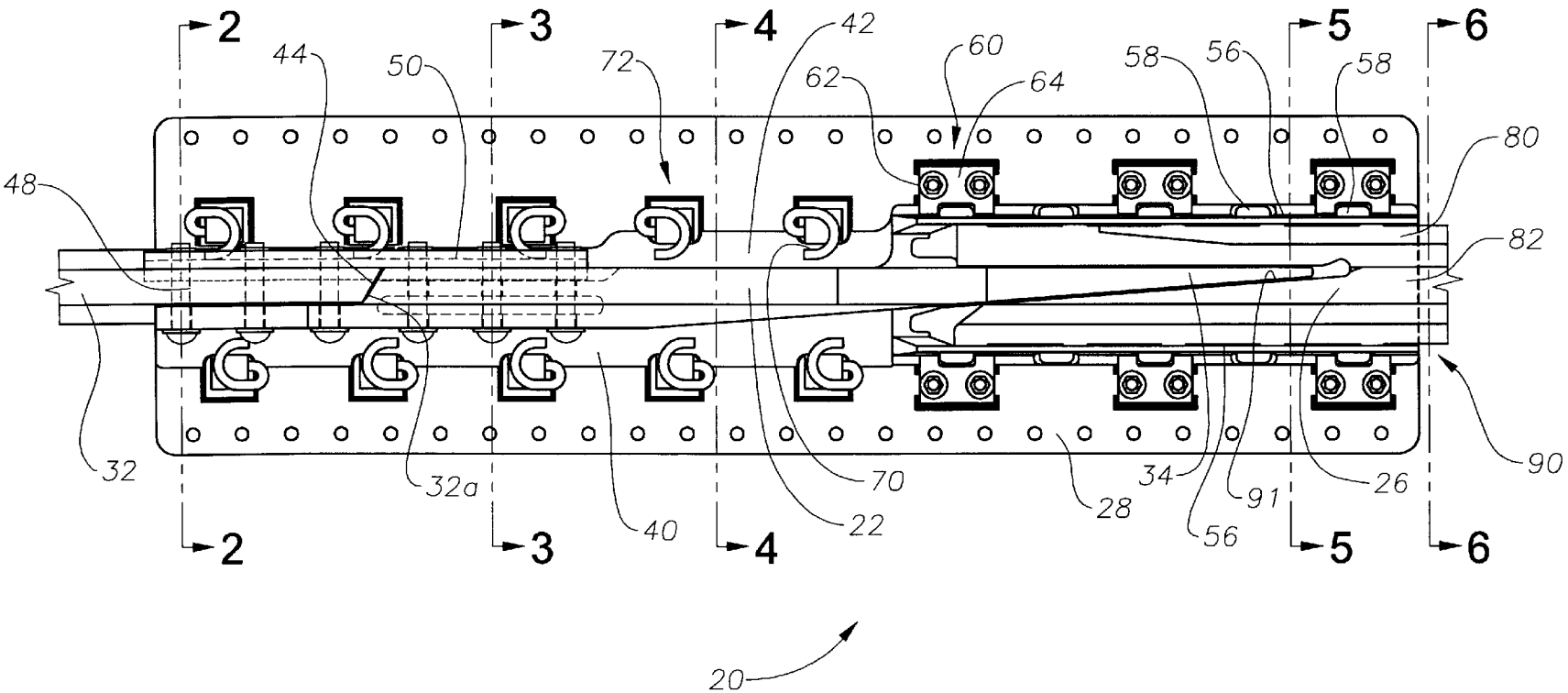
FIG. 1A is a plan view of the fixed half of a bridge joint constructed in accordance with this invention with the rocker arm in an operable position.
Figure 1B:
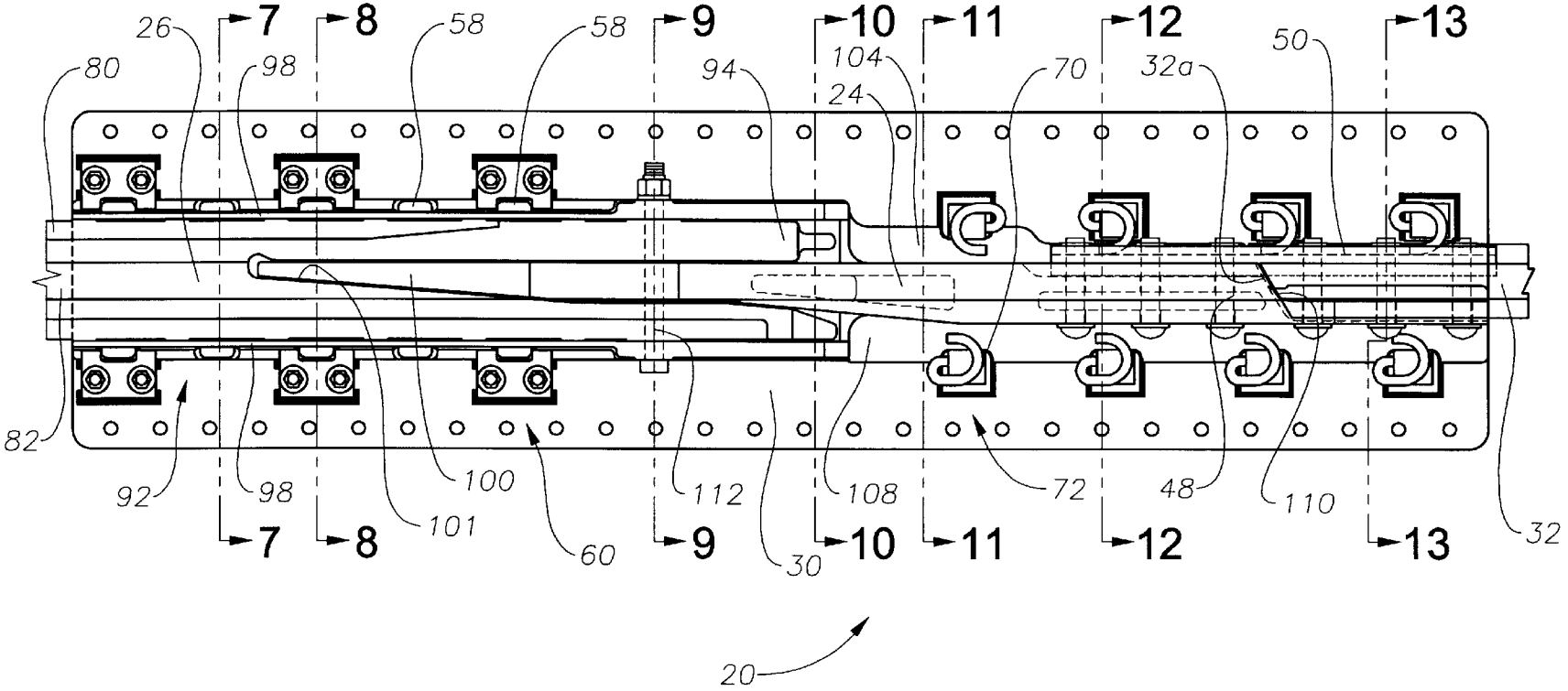
FIG. 1B is a plan view of the moveable half of a bridge joint constructed in accordance with this invention with the rocker arm in an operable position.

Referring to FIGS. 1A and 1B, a bridge joint 20 constructed in accordance with this invention has generally a fixed point section 22 (FIG. 1A) and a moveable point section 24 (FIG. 1B) with a rocker arm 26 interfacing between the point sections 22, 24. Moveable section 24 mounts to a bridge that rotates in a horizontal plane to allow boat traffic to pass. Fixed section 22 remains stationary and is locked to moveable section 24 by rocker arm 26 to allow rail traffic to pass. Rocker arm 26 tilts upward as shown in FIG. 14 to unlock sections 22, 24 from each other, thus allowing the horizontal rotation of the bridge.

Figure 14:
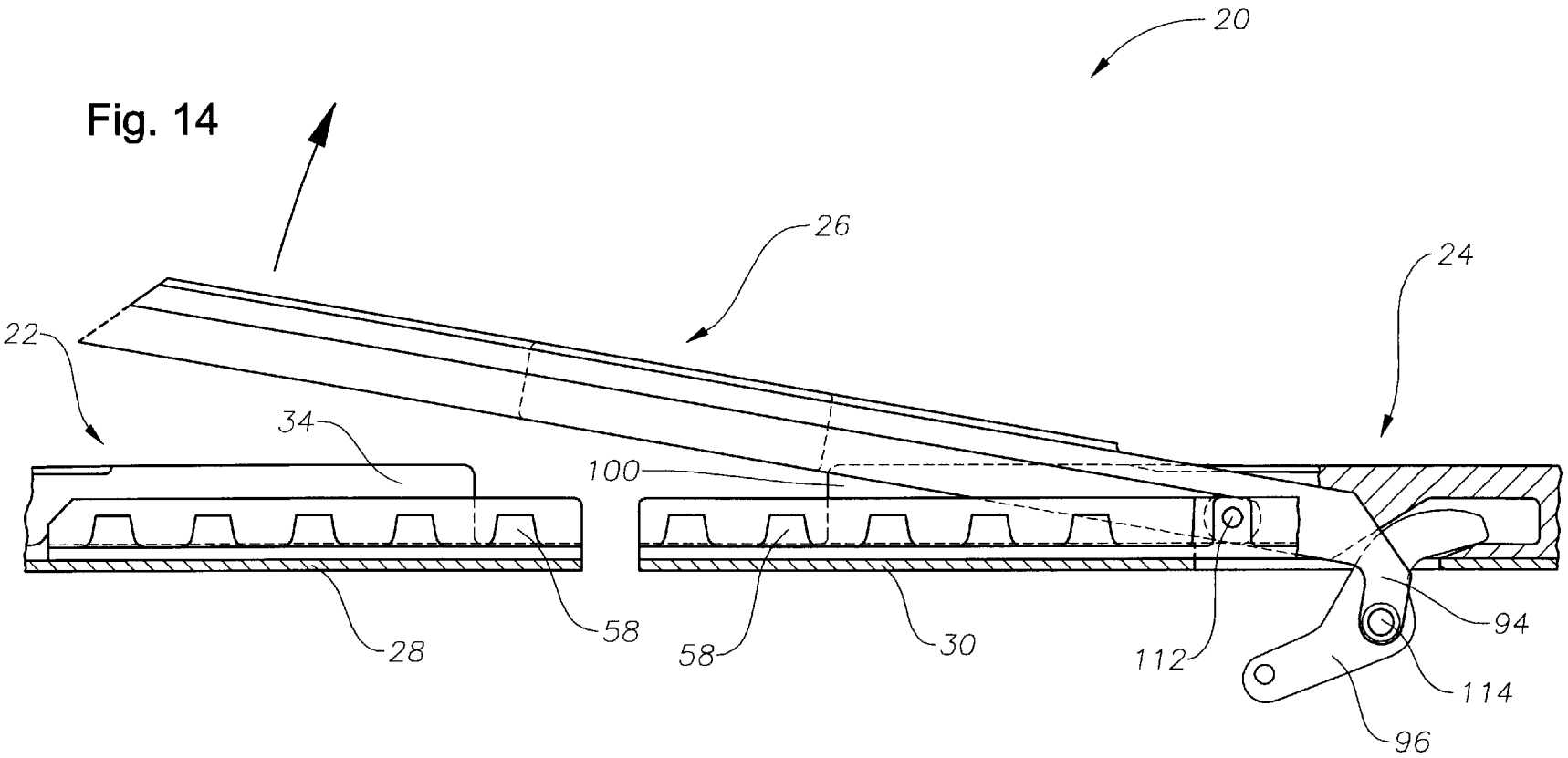
FIG. 14 is an elevational view of the bridge joint of FIGS. 1A and 1B.

Fixed point section 22 is joined to a first planar base plate 28 (FIGS. 1A and 14) and moveable point section 24 is joined to a second planar base plate 30 (FIGS. 1B and 14). Standard rail sections 32 abut the ends of moveable point section 24 and fixed point section 22 and arc joined to base plates 28, 30. Rail sections 32 have diagonal ends 32*a* that abut fixed and moveable sections 22, 24. Fixed point section 22, moveable point section 24, rocker arm 26, and standard rail sections 32 align on longitudinal rail axis A. One bridge joint 20 is used to join one run of standard rail 32, thus in a conventional railway having parallel paired rails 32, two bridge joints 20 would be used at each desired point.

Figure 5:
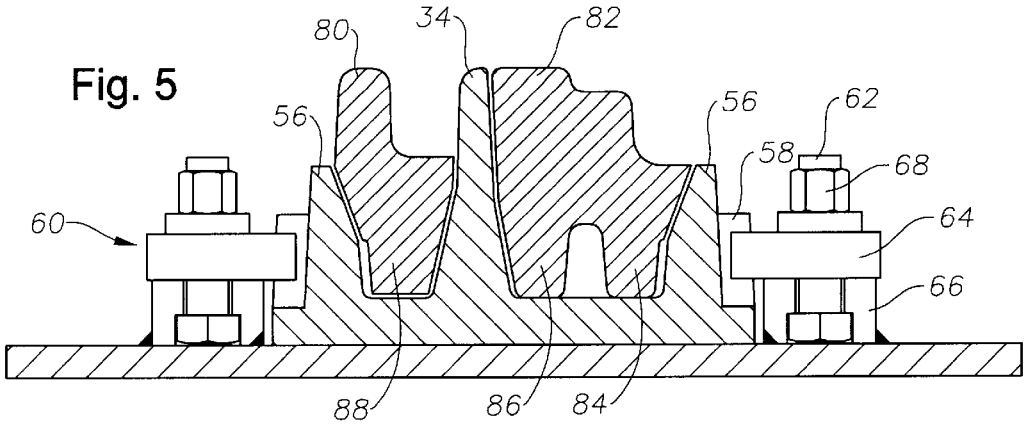
FIG. 5 is a cross sectional view of the bridge joint of FIG. 1A taken along line 5—5 of FIG. 1A.
Figure 8:
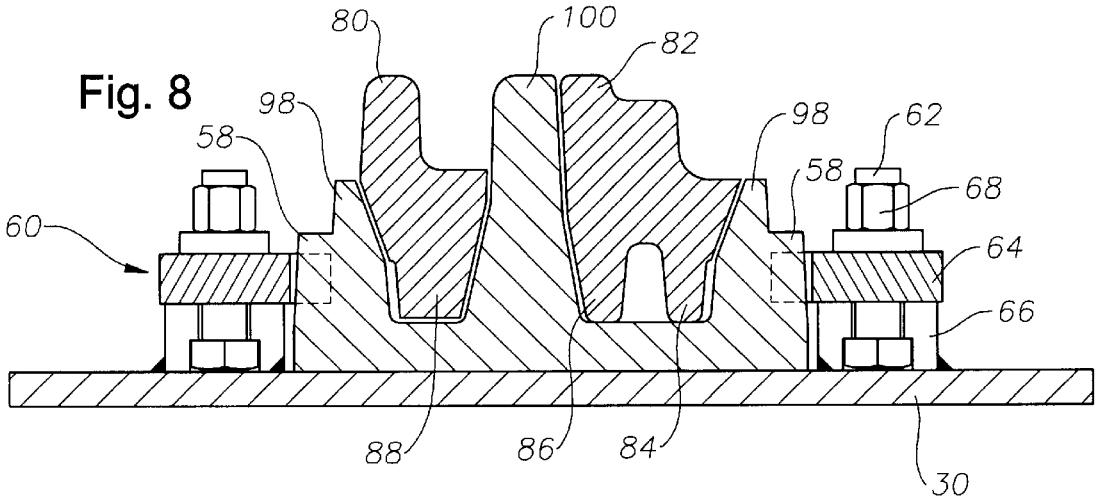
FIG. 8 is a cross sectional view of the bridge joint of FIG. 1B taken along line 8—8 of FIG. 1B.

Each section 22, 24, 26, may generally be divided into functional portions. Fixed point section 22 may be divided into a mating portion and an accepting portion. The mating portion is designed to attach fixed point section 22 to standard rail section 32. The accepting portion is designed to receive rocker arm 26 in a locked position. Similarly, moveable point section 24 may be divided into a yoke portion and a mating portion. The yoke portion is similar to the accepting portion of fixed point section 22, with added structure for pivotally securing one end of rocker arm 26. The mating portion of moveable point section 24 is nearly identical to the mating portion of fixed point section 22. Rocker arm 26 is comprised of a fixed interface portion 90 and a moveable interface portion 92. Fixed interface portion 90 is designed to nest into the accepting portion of fixed point section 22 when rocker arm 26 is lowered into a locked position as shown in FIGS. 1A and 5. Moveable interface portion 92 is designed to attach pivotally to the yoke portion moveable point section 24, so that it may pivot upwards, as shown in FIG. 14, and nest in the yoke portion of moveable point section 24 when in a locked position to provide a continuous surface for rail traffic, as shown in FIGS. 1B and 8.

Figure 4:
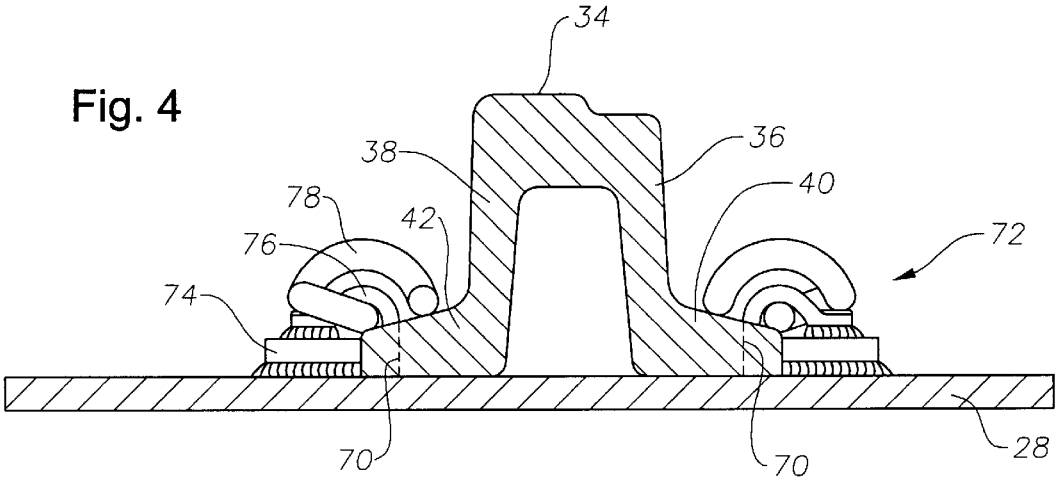
FIG. 4 is a cross sectional view of the bridge joint of FIG. 1A taken along line 4—4 of FIG. 1A.

Fixed point section 22 is a cast piece with integral features. Fixed point section 22 has a point member 34 centered about axis A and substantially continuous with the top surface of standard rail 32. As seen in FIG. 4, point member 34 is supported by an outer point web 36 and inner point web 38. The lower ends of outer and inner fixed point webs 36, 38 flare away from axis A to form an outer flange 40 and an inner flange 42. Referring again to FIG. 1A, one end of fixed point section 22 is angled relative to axis A to abut standard rail end 32*a* with a mating angle 44 at the termination of inner point web 38 and the extension of outer point web 36.

Figure 2:
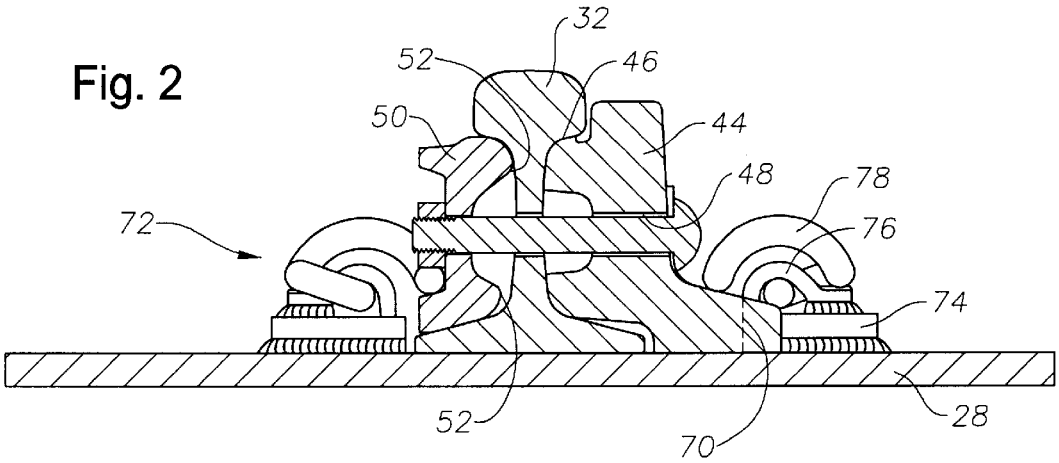
FIG. 2 is a cross sectional view of the bridge joint of FIG. 1A taken along line 2—2 of FIG. 1A.
Figure 3:
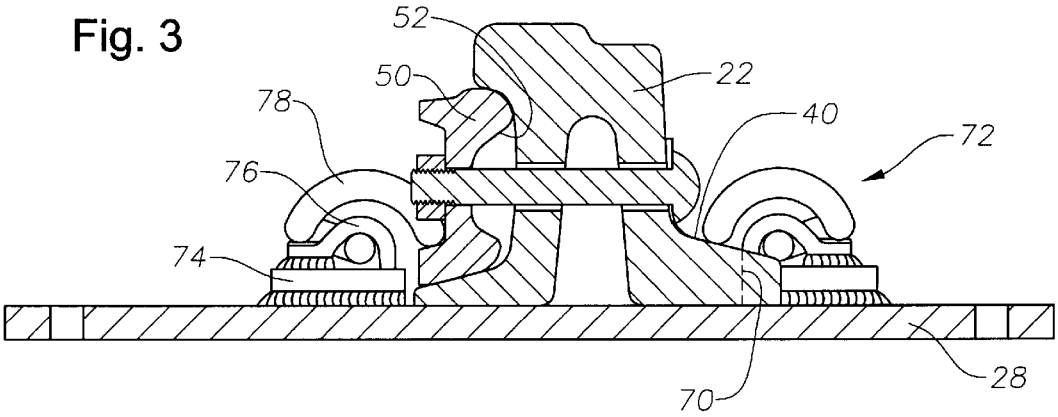
FIG. 3 is a cross sectional view of the bridge joint of FIG. 1A taken along line 3—3 of FIG. 1A.

Outer point web 36, outer flange 40, and a portion of point member 34 extend to form the standard rail mating portion. Standard rail 32 is placed abutting mating angle 44. Referring to FIG. 2, the extension of outer point web 36 has lateral projections 46 adapted to laterally abut and secure standard rail section 32. Webs 36, 38 have transverse bolt holes 48 for bolting a splicing member 50 (FIGS. 1A, and 2). Splicing member 50 has lateral projections 52 (FIG. 2) adapted to laterally abut and secure standard rail section 32. Standard rail section 32 is placed between the extension of outer point web 36 and splicing member 50 and bolted to fixed point section 22 through bolt holes 48 (FIG. 2). Splicing member 50 is also independently bolted to fixed point section 22 (FIG. 3).

Opposite the mating portion of fixed point section 22 is die accepting portion which includes point member 34 and spaced side walls 56 to accept fixed interface portion 90 of rocker arm 26. Point member 34 narrows at an acute angle relative to axis A. Side walls 56 are adapted to closely abut fixed interface portion 90 and maintain its alignment about axis A.

Referring again to FIG. 1A, fixed point section 22 has a plurality of clamping lugs 58 integrally formed on side walls 56. Clamping lugs 58 are substantially rectangular, but narrow slightly near their top as measured parallel to axis A as shown in FIG. 14. A plurality of clamps 60 correspond to clamping lugs 58 and can be seen in FIG. 5. Clamps 60 consist of one or more threaded members 62, a clamping plate 64, and a clamp base 66. Clamp base 66 is secured to base plate 28 and holds threaded member 62 to face upward. Clamping plate 64 engages and retains vertical and horizontal movement of clamping lug 58. Clamping plate 64 is placed over threaded member 62 and secured with a nut 68. With nut 68 tightened on clamping plate 64, fixed point section 22 is secured to base plate 28.

Returning to FIG. 1A, a plurality of notches 70 in flanges 40, 42 partially accept corresponding quick release fasteners 72 secured to base plate 28. Notches 70 are also shown in FIGS. 2, 3, 4, 11, 12 and 13. Fasteners 72 are quick release rail fasteners known to those skilled in the art. Each fastener 72 is secured to a stop block 74 (FIG. 3) which is secured to base plate 28. Stop block 74 engages a notch 70 and prevents movement of fixed point section 22 along axis A. Fastener 72 has a shoulder plate 76 joined to stop block 74 and a spring clip 78 arranged such that spring clip 78 can be driven into shoulder plate 76, and a portion of spring clip 78 will exert a downward force on fixed point section 22 thus securing fixed point section 22 to base plate 28. Additional quick release fasteners 72 secured to base plate 28 are provided to secure splicing member 50 and standard rail section 32 as shown in FIGS. 2, 3, 12, and 13. These additional fasteners 72 have shortened stop blocks 74 as there are no notches in standard rail sections 32.

Figure 6:
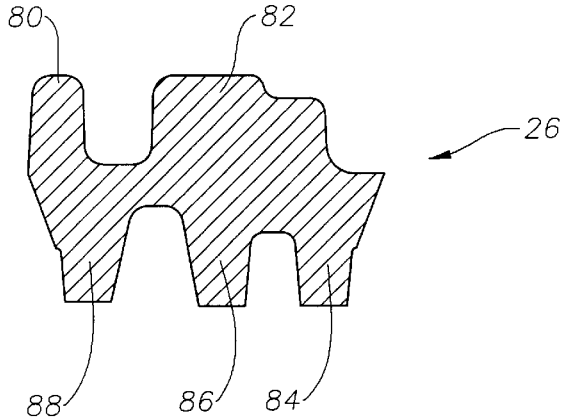
FIG. 6 is a cross sectional view of the bridge joint of FIG. 1A taken along line 6—6 of FIG. 1A.
Figure 9:
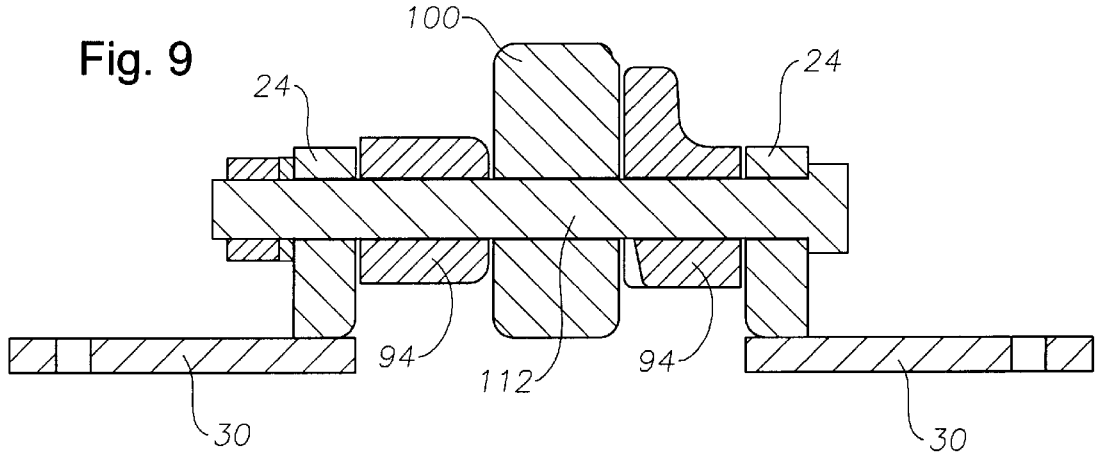
FIG. 9 is a cross sectional view of the bridge joint of FIG. 1B taken along line 9—9 of FIG. 1B.
Figure 10:
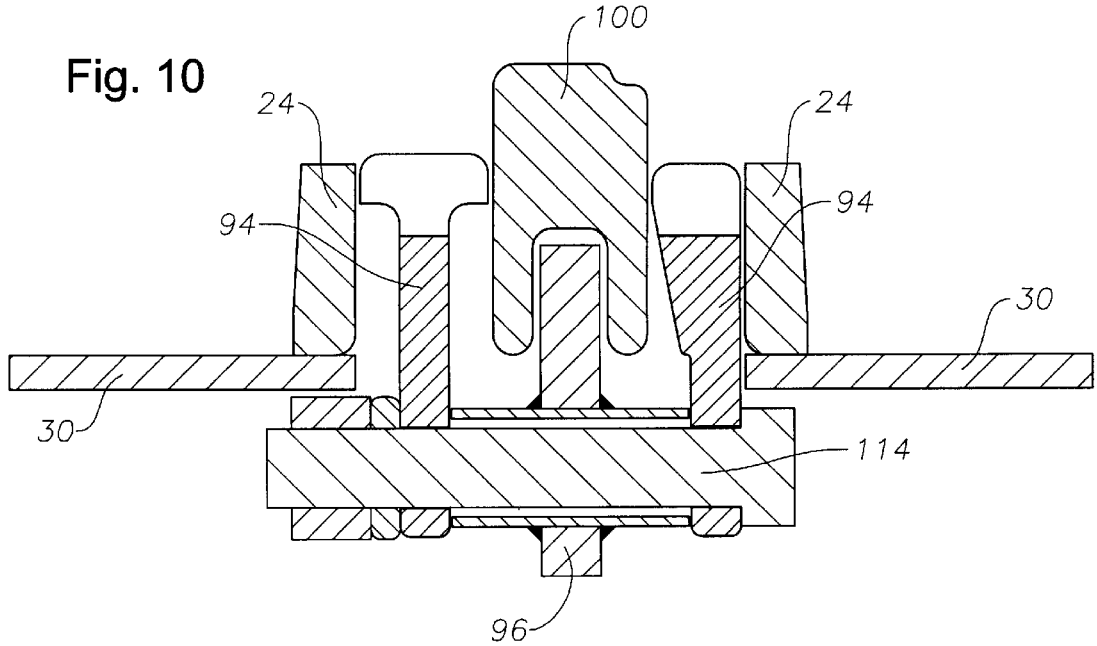
FIG. 10 is a cross sectional view of the bridge joint of FIG. 1B taken along line 10—10 of FIG. 1B.

Rocker arm 26 is a cast piece with integral features thereon. Rocker arm is pivotally mounted to moveable section 24 and extend to engagement with fixed section 22 when in a lowered and locked position to provide a continuous surface between fixed section 22 and moveable section 24 for rail traffic. When viewed from above, as in FIGS. 1A and 1B, rocker arm 26 has two distinct features, a guard 80 and a body member 82. Body member 82 is centered about axis A with a top surface that is substantially continuous with the top surfaces of the point members 34, 100 and standard rails 32 to generally form the surface that a rail car rides on. Guard 80 is an integrally formed component of rocker arm 26 that runs generally longitudinally alongside axis A, curves toward axis A in the center, and outward at both ends. As seen in FIG. 6, body member 82 is supported by outer body web 84 and inner body web 86, and guard 80 is supported by guard web 88. Rocker arm 26 is generally divided into two portions. Fixed interface portion 90 has a slot 91 that allows rocker arm 26 to lay into accepting portion of fixed point section 22. Moveable interface portion 92 is pivotally attached to yoke portion 98 of the moveable point section 24 (FIGS. 1B, 9, and 14). Beyond moveable interface portion 92 webs 84, 86, 88 form a clevis 94 that extends below base plate 30 (FIGS. 10 and 14). As shown in FIG. 14, clevis 94 is connected to a lever 96 that is connected to an actuator (not shown) that is part of the bridge structure (not shown). The actuator pulls down on lever 96, lever 96 pulls down on clevis 94 and fixed interface portion 90 of rocker arm 26 raises out of accepting portion of fixed point section 22. FIG. 14 shows rocker arm 26 tilted upward to allow horizontal movement of moveable point section 24 relative to fixed point section 22.

Figure 11:
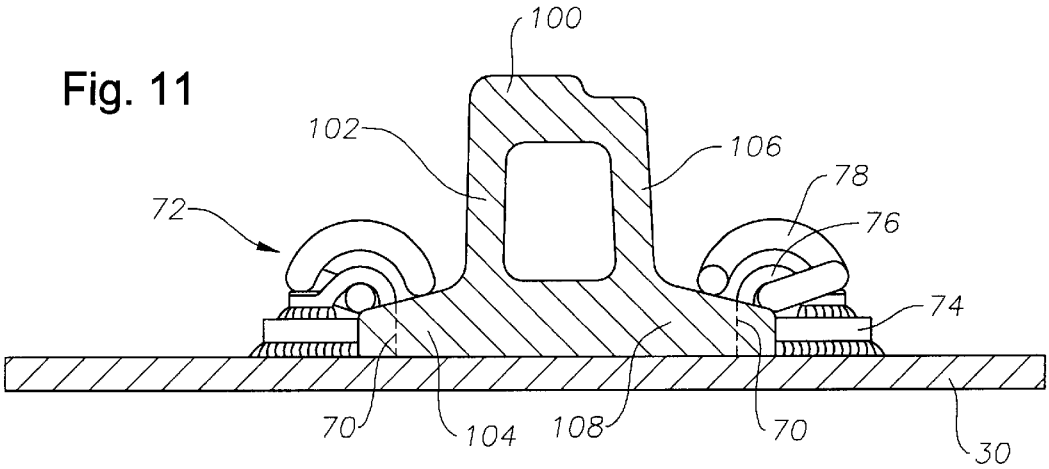
FIG. 11 is a cross sectional view of the bridge joint of FIG. 1B taken along line 11—11 of FIG. 1B.

Moveable point section 24 is a cast piece with integral features similar to fixed point section 22. As seen in FIG. 1B, moveable point section 24 has the yoke portion with a point member 100. Rocker arm 26 has a slot 101 that receives point member 100. The mating portion of moveable point section 24 is angled relative to axis A to accept end 32*a* of standard rail 32 with a mating angle 110. Moveable point section 24 has inner point web 102 and inner flange 104 (FIG. 11). Outer point web 106, outer flange 108, and a portion of point member 100 extend to form a standard rail mating portion similar to that in fixed point section 22 (FIGS. 1B, 11, 12, and 13). A splicing member 50 is bolted to moveable point section 24 and standard rail 32 as discussed above (FIGS. 1B, 12 and 13).

The yoke portion secures the moveable inter face portion 92 of rocker arm 26 pivotally while also receiving moveable interface portion 92 as it pivots downward. The yoke portion is similar to the accepting portion of fixed point section 22 in that side walls 98 are laterally spaced from point 100, although it is adapted to pivotally secure the rocker arm 26. Pivot pin 112 (FIGS. 1B and 9) extends from one side of moveable point section 24 through clevis 94 to an opposite side of moveable point section 24, passing through point member 100 in the middle as shown in FIG. 9. Pivot pin 112 secures clevis 94 of rocker arm 26 pivotally to the yoke portion of moveable point section 24. Clevis pin 114 secures lever 96 pivotally to clevis 94 as shown in FIG. 10. By rotating on pivot pin 112, rocker arm 26 moves from an operational position, with body member 82 forming a nearly continuous rail surface between point member 34 and point member 100, and a storage position, with rocker arm 26 clear of fixed point section 22 as shown in FIG. 14.

Figure 12:
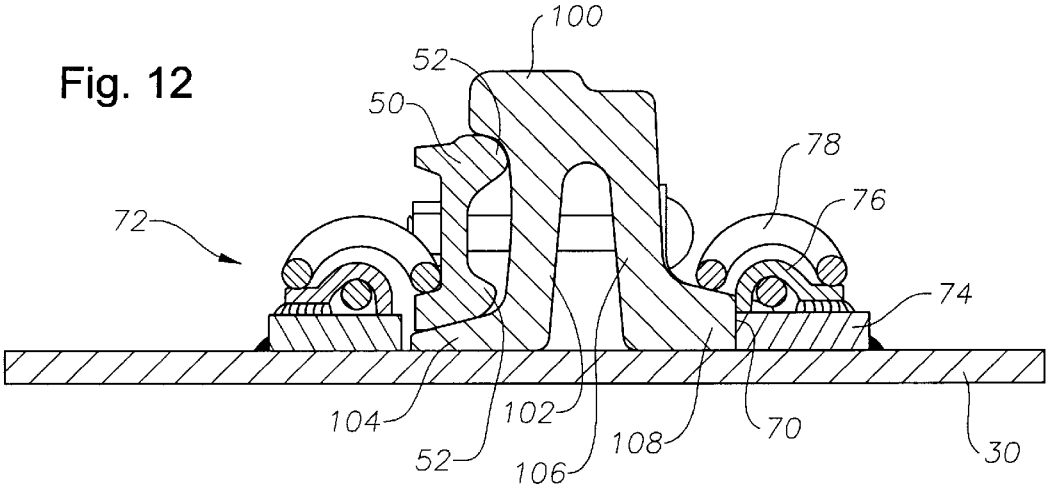
FIG. 12 is a cross sectional view of the bridge joint of FIG. 1B taken along line 12—12 of FIG. 1B.
Figure 13:
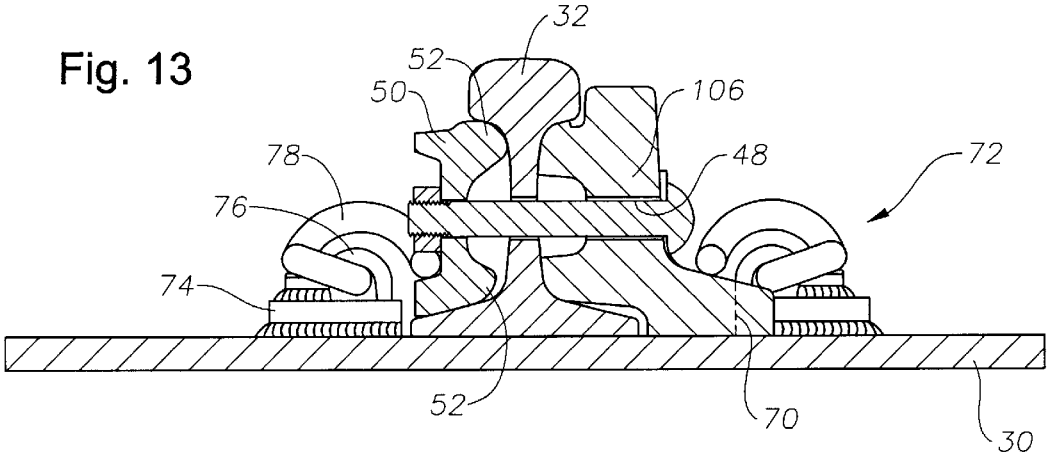
FIG. 13 is a cross sectional view of the bridge joint of FIG. 1B taken along line 13—13 of FIG. 1B.

Moveable point section 24 has a plurality of spaced clamping lugs 58 (FIGS. 1B, 7, and 8) as described above in relation to fixed point section 22 and corresponding clamps 60 on base plate 30 secure it to base plate 30. A plurality of quick release fasteners 72 on stop blocks 74 attached to base plate 30 reside in notches 70 along outer flange 108 and inner flange 104, and secure moveable point 24 to base plate 30 (FIGS. 1B, 11, and 12). Additional fasteners 72 secure splicing member 50 and standard rail section 32 as described above (FIG. 13).

Though the above embodiment is disclosed using the preferable combination of clamps 60 and quick release fasteners 72, it is also possible to use entirely clamps 60 or entirely quick release fasteners 72 to hold the fixed point section 22 and moveable point section 24 to their respective base plates 28, 30.

In operation, fixed point section 22 is secured to base plate 28 and moveable point section 24 is secured to base plate 30 as shown in FIGS. 1A and 1B. Rocker arm 26 pivots upward to a storage a position that allows moveable point section 24 to move horizontally relative to fixed point section, as shown in FIG. 14. Rocker arm 26 may also pivot down into a locked operational position wherein the fixed interface portion 90 of rocker arm 26 nests in the accepting portion of fixed point section 22 (FIGS. 1A and 1B). When rocker arm 26 is in the operational position the point 34 of fixed point section 22, body 82 of rocker arm 26, point 100 of moveable point section and standard rail sections 32 form a nearly continuous surface along axis A for rail traffic to traverse (FIGS. 1A and 1B).

Figure 7:
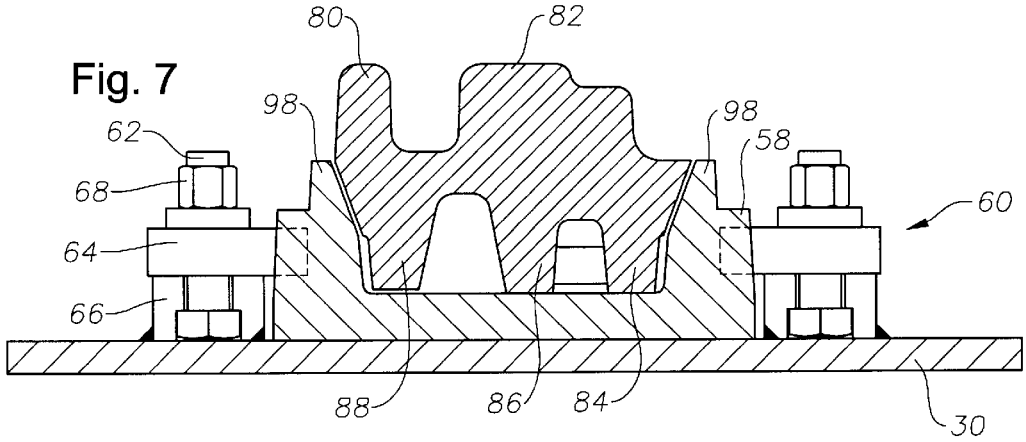
FIG. 7 is a cross sectional view of the bridge joint of FIG. 1B taken along line 7—7 of FIG. 1B.

As fixed point section 22, moveable point section 24, rocker arm 26, and standard rails 32 wear, they can be removed and replaced without removing base plates 28, 30 from the bridge or structure to which they are attached. Bridge joint 20 is disassembled by loosening nuts 68 and disassembling clamps 60 (FIGS. 5, 7, and 8). No access beneath base plates 28, 30 is required. Standard rail section 32 is unbolted from mating portions 44, 110 of fixed point section 22 and moveable point section 24, and splicing members 50 are removed (FIGS. 2,3, 12, and 13). Quick release fasteners 72 are released by driving spring clips 78 out of shoulder plates 76 (FIGS. 2, 3, 4, 11, 12, and 13). Fixed point section 22 and moveable point section 24 can then be lifted vertically from base plates 28, 30 and scrapped. Standard rail sections 32 can also be removed as they are no longer secured to base plates 28, 30.

Bridge joint 20 can be reassembled by positioning rocker arm 26 in the operational position engaging fixed point section 22 by moving moveable point section 24 into alignment with fixed point section 22 along axis A. Fixed point section 22 and moveable point section 24 are then placed on base plate 28 and base plate 30, respectively. Clamps 60 are assembled and nuts 68 are tightened, partially securing fixed point section 22 and moveable point section 24 to their respective base plates 28, 30. Standard rail section 32 is placed abutting mating portion 44 of fixed point section 22. Splicing member 50 is placed abutting standard rail section 32 and mating portion 44 and all three are bolted together. A second standard rail section 32 is secured to moveable point section 24 in the same manner. Spring clips 78 are then driven into each shoulder plate 76 of each quick release fastener 72 to secure the remaining portions of fixed point section 22 and moveable point section 24 and secure standard rail sections 32 to base plates 28, 30.

The present invention has many significant advantages. The present invention employs base plates which arc separate from the bridge joint sections. The bridge joint sections are not attached to the base plates with through bolts, thus do not require access to the bottom side of the plates for removal. Bridge joint sections can be removed with simple hand tools leaving the base plates in position. Further, there are no welds that must be ground to release the bridge joint sections.

While the invention has been shown in only one of its forms, it should be apparent to those skilled in the art that it is not so limited, but is susceptible to various changes without departing from the scope of the invention.

I claim:

1. A bridge joint for use with a railroad track having standard rail sections, said bridge joint comprising:

a first base plate adapted to be mounted to a stationary portion of a bridge structure;

a second base plate adapted to be mounted to a moveable portion of a bridge structure for movement therewith;

a fixed point section on said first base plate having an abutting end adapted to abut a rail on a stationary portion of a bridge structure, said fixed point section having a first point opposite said abutting end and flanges extending laterally from said fixed point section;

a moveable point section on said second base plate having an abutting end adapted to abut a rail on a moveable portion of a bridge structure, said moveable point section having a second point opposite said abutting end extending towards said point of said fixed point section and flanges extending laterally from said fixed point section;

a rocker arm pivotally mounted to said moveable point section to move from a locked position to a storage position and having a first slot for receiving said first point when said rocker arm is in said locked position and a second slot for receiving said second point when rocker arm is in said locked position, said rocker arm being free of said fixed point section when pivoted to a storage position so that said moveable point section may move laterally relative to said fixed point section; and a plurality of fasteners secured to said base plates and said flanges, securing said fixed point section to said first base plate and said moveable point section to said second base plate, said fasteners being tightened and loosened entirely from upper sides of said base plates.

2. The bridge joint of claim 1 further comprising:

a plurality of vertically tapered clamping lugs positioned on an exterior surface of said fixed point section and said moveable point section; and a plurality of clamping plates engaging said clamping lugs, said clamping plates secured to said base plates entirely from a top side of said base plates to restrain vertical and horizontal movement of said lugs and therefore said fixed point section and said moveable point section.

3. The bridge joint of claim 2 wherein:

said fixed point section is further comprised of side walls spaced on either side of said first point to further support said rocker arm when in a locked position; and said clamping lugs are on an exterior surface of said side walls.

4. The bridge joint of claim 2 wherein:

said moveable point section is further comprised of side walls spaced on either side of said second point to further support said rocker arm when in a locked position; and said clamping lugs are on an exterior surface of said side walls.

5. The bridge joint of claim 2 wherein:

each of said fasteners is mounted to a stop block; and said flanges have notches to engage said stop blocks.

6. The bridge joint of claim 1 wherein:

a flange of a standard rail section is secured to said base plate with said fasteners.

7. The bridge joint of claim 1 wherein:

each of said fasteners is mounted to a stop block; and said flanges have notches to engage said stop blocks.

8. A bridge joint for use with a railroad track having standard rail sections, said bridge joint comprising:

a first base plate adapted to be mounted to a stationary portion of a bridge structure;

a second base plate adapted to be mounted to a moveable portion of a bridge structure for movement therewith;

a fixed point section on said first base plate having an abutting end adapted to abut a rail on a stationary portion of a bridge structure, said fixed point section having a first point opposite said abutting end and side walls spaced laterally from said first point;

a moveable point section on said second base plate having an abutting end adapted to abut a rail on a moveable portion of a bridge structure, said moveable point section having a second point opposite said abutting end extending towards said point of said fixed point section and side walls spaced laterally from said second point;

a rocker arm pivotally mounted to said moveable point section to move from a locked position to a storage position and having a first slot for receiving said first point when said rocker arm is in said locked position and a second slot for receiving said second point when rocker arm is in said locked position, said rocker arm nesting between said side walls of said fixed point section when in a locked position and being free of said fixed point section when pivoted to a storage position so that said moveable point section may move laterally relative to said fixed point section;

a plurality of vertically tapered clamping lugs positioned on said fixed point section and said moveable point section; and a plurality of clamping plates engaging said clamping lugs, said clamping plates releasably secured to said base plates entirely from a top side of said base plates to restrain vertical and horizontal movement of said lugs and therefore said fixed point section and said moveable point section.

9. The bridge joint of claim 8 wherein:

said clamping lugs are positioned on an exterior surface of said side walls of said fixed point section.

10. The bridge joint of claim 8 wherein:

said clamping lugs are positioned on an exterior surface of said side walls of said moveable section.

11. The bridge joint of claim 8 wherein:

said clamping plates arc secured to said base plates by threaded members mounted to said base plates.

12. The bridge joint of claim 8 wherein:

said fixed point section has laterally extending flanges;

said moveable point section has laterally extending flanges; and stop blocks arc mounted to said base plates with fasteners mounted on said stop blocks securing said flanges to said base plates, said fasteners having spring clips for engaging said flanges and securing said fixed point section to said first base plate and said moveable point section to said second base plate such that said fasteners may be tightened or loosened entirely from the top side of said base plates.

13. The bridge joint of claim 12 wherein:

said standard rail sections have flanges; and stop blocks are mounted to said base plates with fasteners mounted on said stop blocks securing said flanges to said base plates, said fasteners having spring clips for engaging said flanges and securing standard rail sections to said base plates.

14. The bridge joint of claim 12 wherein:

a plurality of said fasteners are mounted on stop blocks; and said flanges have notches which engage said stop blocks to prevent horizontal movement of said moveable point section and said fixed point section.

15. The bridge joint of claim 8 wherein:

fasteners engage flanges on standard rail sections, thereby securing the standard rail sections to said base plates.

16. A method of allowing horizontal movement of a railway bridge moveable section relative to a stationary bridge section, comprising the steps of:

providing a fixed point section having an accepting portion, a rail mating portion, and flanges, a moveable point section having a yoke portion, a standard rail mating portion, and laterally extending flanges, a rocker arm having a fixed interface portion and a moveable interface portion, and first and second base plates with clamps and quick release fasteners thereon;

securing said moveable interface portion of said rocker arm pivotally to said yoke portion of said moveable point section;

placing said forward interface portion of said rocker arm in said accepting portion of said fixed point section;

securing a first standard rail section to said mating portion of said fixed point section and securing a second standard rail section to said mating portion of said moveable point section;

positioning said fixed point section and the first standard rail section on a first base plate and said moveable point section and the second standard rail section on a second base plate;

securing said accepting portion of said fixed point section to said first base plate and said yoke portion of said moveable point section to said second base plate with clamps entirely from an upper side of said base plates;

securing the flanges of said fixed point section and said moveable point section to said base plates with fasteners entirely from a top side of said base plates;

pivoting said rocker arm vertically out of contact with and clear of said fixed point section into a storage position; and rotating said moveable bridge section horizontally relative to said fixed bridge section.

* * * * *